US008128182B2

(12) United States Patent
DeWeerd

(10) Patent No.: US 8,128,182 B2
(45) Date of Patent: Mar. 6, 2012

(54) REVERSIBLE WALL TRACK SYSTEM FOR OFFICE FURNITURE

(75) Inventor: Jason DeWeerd, Allegan, MI (US)

(73) Assignee: Haworth, Inc., Holland, MI (US)

( * ) Notice: Subject to any disclaimer, the term of this patent is extended or adjusted under 35 U.S.C. 154(b) by 130 days.

(21) Appl. No.: 12/800,313

(22) Filed: May 12, 2010

(65) Prior Publication Data

US 2010/0289392 A1 Nov. 18, 2010

Related U.S. Application Data

(60) Provisional application No. 61/216,195, filed on May 14, 2009.

(51) Int. Cl.
*A47B 67/02* (2006.01)

(52) U.S. Cl. ..... 312/247; 312/198; 211/103

(58) Field of Classification Search ..... 312/245–247, 312/198; 108/107, 108; 248/220.21, 220.31, 248/220.43, 225.21; 211/103, 190, 207, 211/192

See application file for complete search history.

(56) References Cited

U.S. PATENT DOCUMENTS

| | | | | |
|---|---|---|---|---|
| 2,355,651 | A * | 8/1944 | Hormes | 248/243 |
| 3,722,157 | A | 3/1973 | Prokop | |
| 3,993,002 | A * | 11/1976 | Stroh | 108/108 |
| 4,048,768 | A | 9/1977 | Good | |
| 4,154,419 | A | 5/1979 | Breidenbach | |
| 4,884,375 | A * | 12/1989 | Wendt | 52/36.6 |
| 5,004,198 | A * | 4/1991 | Jager | 248/224.8 |
| 5,870,867 | A | 2/1999 | Mitchell | |
| 6,109,461 | A | 8/2000 | Kluge et al. | |
| 6,112,913 | A * | 9/2000 | Rindoks et al. | 211/90.02 |
| 6,349,516 | B1 | 2/2002 | Powell et al. | |
| 6,393,783 | B2 | 5/2002 | Emaus et al. | |
| 6,418,671 | B1 | 7/2002 | DeRuiter et al. | |
| 6,726,034 | B2 * | 4/2004 | Holbrook et al. | 211/87.01 |
| 6,820,388 | B2 | 11/2004 | Newhouse et al. | |
| 7,311,211 | B2 * | 12/2007 | Chung | 211/90.02 |
| 7,506,772 | B2 * | 3/2009 | Chen | 211/103 |
| 7,669,945 | B2 * | 3/2010 | Blersch et al. | 312/408 |
| 2003/0234231 | A1 * | 12/2003 | Rowe | 211/90.02 |
| 2005/0145147 | A1 * | 7/2005 | Costa et al. | 108/108 |
| 2007/0221595 | A1 * | 9/2007 | Chen | 211/103 |
| 2010/0289392 | A1 * | 11/2010 | DeWeerd | 312/245 |

* cited by examiner

*Primary Examiner* — Janet M Wilkens
*Assistant Examiner* — Daniel Rohrhoff
(74) *Attorney, Agent, or Firm* — Flynn, Thiel, Boutell & Tanis, P.C.

(57) ABSTRACT

A wall track system is provided with overhead storage cabinets or other furniture components to accommodate mounting of the furniture components in multiple configurations in a minimum of space. This system includes wall tracks which have two opposite side faces with two different slot patterns that accommodate two different mounting orientations for the furniture components.

20 Claims, 5 Drawing Sheets

E2
14
12
10
OR2
19
15
18
12
19
OR1
15
18
OR1
IL1
19
12
15
12
OR2
26
E1
18
25
26

16
17
15
17
OR1
26
15
35
30
27
IL1
16

17
15
16
OR2
26
31
18
12
E1

REVERSIBLE WALL TRACK SYSTEM FOR OFFICE FURNITURE

CROSS REFERENCE TO RELATED APPLICATION

This application claims the benefit of U.S. Provisional Application Ser. No. 61/216,195, filed May 14, 2009, which is incorporated herein by reference in its entirety.

FIELD OF THE INVENTION

The invention relates to a wall track system for office furniture and in particular, a reversible wall track system using a reversible wall track to eliminate overhang of the wall tracks on end-of-run locations along a series of suspended office furniture components.

BACKGROUND OF THE INVENTION

Conventional wall tracks or uprights for suspending furniture typically are elongate U-shaped rails having a vertical row of spaced-apart slots along the vertical length thereof. These slots cooperate with mounting or support brackets provided on various furniture components such as overhead storage units, shelving and the like. These mounting brackets have a generally conventional construction comprising a main plate-like body which attaches to the furniture component being suspended from the wall track, which bracket further includes a row of hooks which project rearwardly and then downwardly in a conventional L-shaped hook configuration. The hooks are vertically spaced so as to each fit rearwardly within a respective one of the slots and then be shifted downwardly into secure engagement with the slots.

In conventional wall track systems, each wall track or upright for a particular furniture system has a common pattern of slots both in size and vertical spacing so as to conform to the hook configuration on the mounting brackets. Typically, each wall track has a single pattern of slots wherein the slots are configured to accommodate a mounting bracket in the leftward position and another mounting bracket sidewardly adjacent thereto in a rightward position wherein two brackets may be connected to the single wall bracket in side-by-side relation. Hence, when an office furniture or other storage component is provided, such component typically has a mounting bracket provided at each opposite end of the component. For example, the opposite ends of each shelf or each storage cabinet are provided with an end mounting bracket. Further, the furniture components typically have a modular length in a furniture system and in many applications, a series of furniture components are positioned sidewardly next to each other in a row along a wall of a building. Hence, the wall tracks are each mounted in a vertical orientation in horizontally spaced-apart positions along the length of the wall wherein each wall bracket or track is positioned to support one mounting bracket in the rightward position and another mounting bracket in the leftward position so that two furniture components are positioned side by side on the single wall bracket.

Along a single wall configured to mount a series of furniture components, the wall tracks or uprights typically comprise the individual tracks located at the opposite ends of the installation location, namely the end wall tracks, as well as one or more intermediate wall tracks which are disposed in the region located between the end wall tracks. In such a configuration, the intermediate wall tracks each support two mounting brackets and namely two office furniture components thereof. At the opposite ends of the system, each end wall track supports only a single component wall mounting bracket thereon. In such an instance, for example, the end wall track would have the left end of a furniture component mounted on the wall track. However, this leaves one side of the wall track exposed in many applications such that a side edge of the wall track extends outwardly beyond the end edge of the furniture component which is functionally acceptable but is aesthetically undesirable. In this regard, the furniture components may be arranged so as to end in a corner of the wall structure which therefore requires that the end wall track abuts against the adjacent wall with the left side of the wall track being located beyond the edge of the furniture component, which then results in the furniture component being located at an excessive gap or spacing away from the adjacent wall surface. This is visually undesirable in many furniture applications.

It is an object of the invention to overcome disadvantages associated with known wall bracket systems.

The invention therefore relates to an improved wall bracket or wall track system using an improved wall track or upright. This wall track or wall bracket has a tubular construction with two mounting faces preferably formed as opposite first and second side faces of the bracket. On the first mounting face, a first slot pattern is provided with a single row of wide slots located along the center of the wall track that are able to accommodate two mounting brackets of the furniture components in closely adjacent side-by-side relation.

On the second mounting face, the slot pattern is different and namely includes two vertical rows of narrow slots which are located closely adjacent if not at the corner of the wall track. While these two rows define two leftward and rightward mounting locations on the second mounting face, the use of such mounting locations is reversed as compared to the mounting locations on the opposite first mounting face. More specifically, at the left end of run position, the wall track is positioned so that the left side face aligns with the left end of the furniture component being suspended therefrom after which, the mounting bracket on the furniture component is engaged in the leftward slot position. In this manner, the wall track aligns with the left edge of the furniture component so that the wall track and furniture component can be abutted closely, if not directly, in contact with the adjacent wall located in a room corner.

At the opposite rightward end of a series of furniture components, the mounting bracket on the right end of the endmost furniture component would instead engage the rightward mounting slots on the wall track so that this wall track also could be mounted substantially flush or in alignment with the end edge of the furniture component. Hence, the wall track is usable in a first orientation with the first mounting face facing outwardly for use at the end locations of the furniture system.

In the intermediate mounting locations where two side-by-side furniture components are supported, the orientation of the wall track or wall bracket is reversed so that the second mounting face faces outwardly. These slots on the second mounting face thereby accommodate the two mounting brackets in side-by-side relation so that the end edges of adjacent furniture components can be closely adjacent while not abutting against each other when mounted to the wall track at this intermediate position.

Hence, the invention relates to a wall track system using wall tracks or uprights having a reversible construction with a first slot pattern usable at the opposite ends of the furniture system, and a second slot pattern on the opposite mounting face thereof which is usable at the intermediate positions.

This provides significant advantages in providing a single wall track that is usable at both end and intermediate positions and provides a more aesthetically pleasing appearance when furniture components are mounted thereto since the end wall brackets lie flush or in alignment with the end edges of the furniture components.

Other objects and purposes of the invention, and variations thereof, will be apparent upon reading the following specification and inspecting the accompanying drawings.

Figures 1, 1A, 1B:
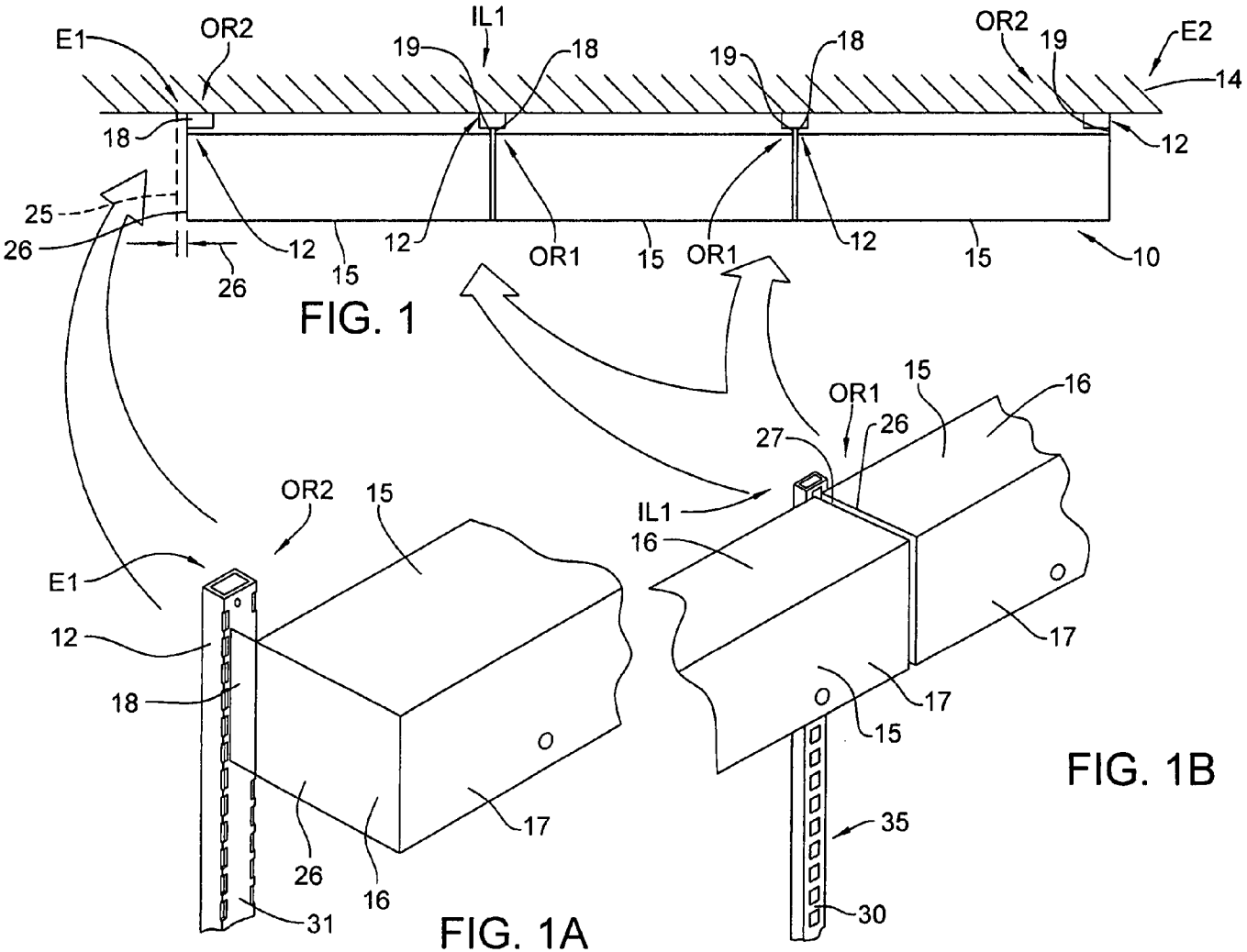
FIG. 1 is a diagrammatic top view of a wall structure with upright wall tracks and overhead storage units mounted thereto.
FIG. 1A is a perspective view illustrating an end-of-run configuration for the wall track and storage cabinets.
FIG. 1B is a perspective view illustrating a middle of run configuration for the wall track and storage cabinets.

Certain terminology will be used in the following description for convenience and reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the arrangement and designated parts thereof. Said terminology will include the words specifically mentioned, derivatives thereof, and words of similar import.

DETAILED DESCRIPTION

Referring to FIG. 1, a wall track system 10 of the invention comprises one or more wall tracks 12 which are vertically elongate and mount to a conventional building wall 14. The wall track system 10 further includes a plurality of furniture components 15 which may be one of any of a variety of constructions including the overhead storage units 15 as shown in FIGS. 1A and 1B, or other constructions such as work surfaces, shelves, other cabinets, tackboards or the like. The wall track system 10 comprising the wall tracks 12 and furniture components 15 essentially defines a wall-mounted furniture system which may be provided in any of a variety of configurations other than the exemplary configuration illustrated in FIGS. 1, 1A and 1B.

Figure 6:
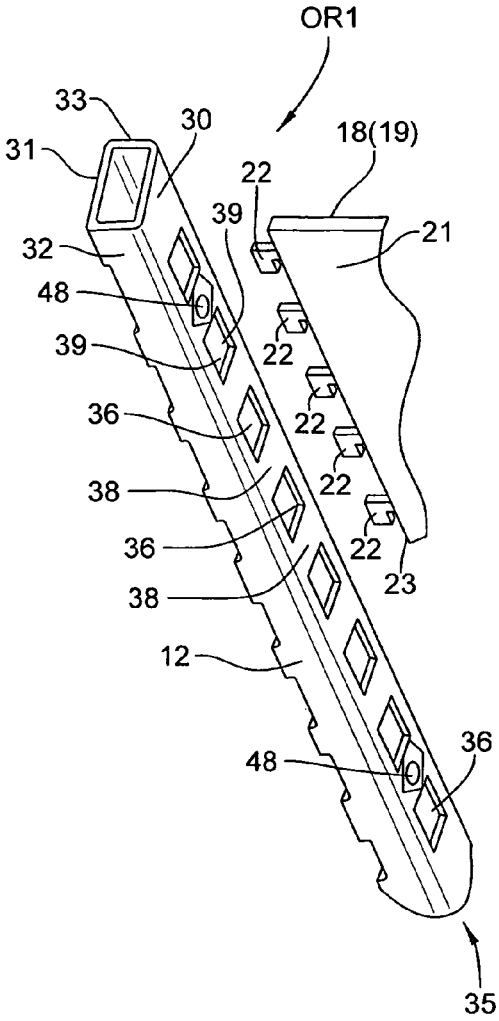
FIG. 6 is a perspective view showing a first mounting face.

As to the overhead storage cabinets 15, such include a box-like housing 16 formed of a rigid frame and an openable door 17 which enclose a storage area 16. As seen in FIGS. 1A, 6, 12 and 13, the housing or other similar frame structure includes left and right mounting brackets 18 and 19 at the opposite ends of the housing, which brackets 18 and 19 are engageable with a wall track 12 as will be described in further detail hereinafter. Referring more particularly to FIG. 6, each of the mounting brackets 18 (19) are formed substantially the same in that they include a plate-like main body 21 having a plurality of vertically spaced, L-shaped support hooks 22 in a vertical row along the back edge 23. Such brackets 18 (19), as well as the particular spacing and structure of such hooks 22, are well known and conventional and may take a variety of different constructions depending upon the manufacturer thereof as well as the different product lines of a particular manufacturer. Generally, the hooks 22 are configured so as to correspond to the specific wall track construction for hooking engagement therewith as described further hereinafter.

Referring again to FIGS. 1, 1A and 1B, the wall tracks 12 are mounted directly to a wall structure 14 such as the stud wall of a building which forms either the interior or exterior building wall. The wall tracks 12 are mounted to the wall 14 in a vertical orientation and are horizontally or laterally spaced apart along the wall 14. Typically, the furniture components 15 have a modular construction wherein the cabinets 15 may have equal modular lengths, although different combinations of component lengths may also be provided. The furniture components 15 typically are mounted in series one next to the other in end-to-end relation as illustrated in FIGS. 1, 1A and 1B. Depending upon the particular size of the cabinets, the particular lateral spacing of the wall tracks 12 varies so as to accommodate the different or equal size cabinets 15. It is noted that the cabinets 15 may be disposed in the middle portion of the wall 14 as generally seen in solid outline in FIG. 1, although the wall track system 10 of the invention may also be disposed closely adjacent to a corner wall wherein a second corner wall oriented at right angles to wall 14 is identified by reference numeral 25. The inventive wall track system 10 allows for close positioning of the endmost furniture cabinets 15 adjacent to the wall 25 so as to define a minimal spacing 26 between the wall surface 25 and the opposed end face 26 of the cabinet. It is noted that the cabinets also include the end face 27 at the opposite end thereof wherein adjacent end faces 26 and 27 of two cabinets 15 seen in FIG. 1B are disposed closely adjacent to each other to define a minimal gap therebetween.

Figures 2, 3, 4, 5:
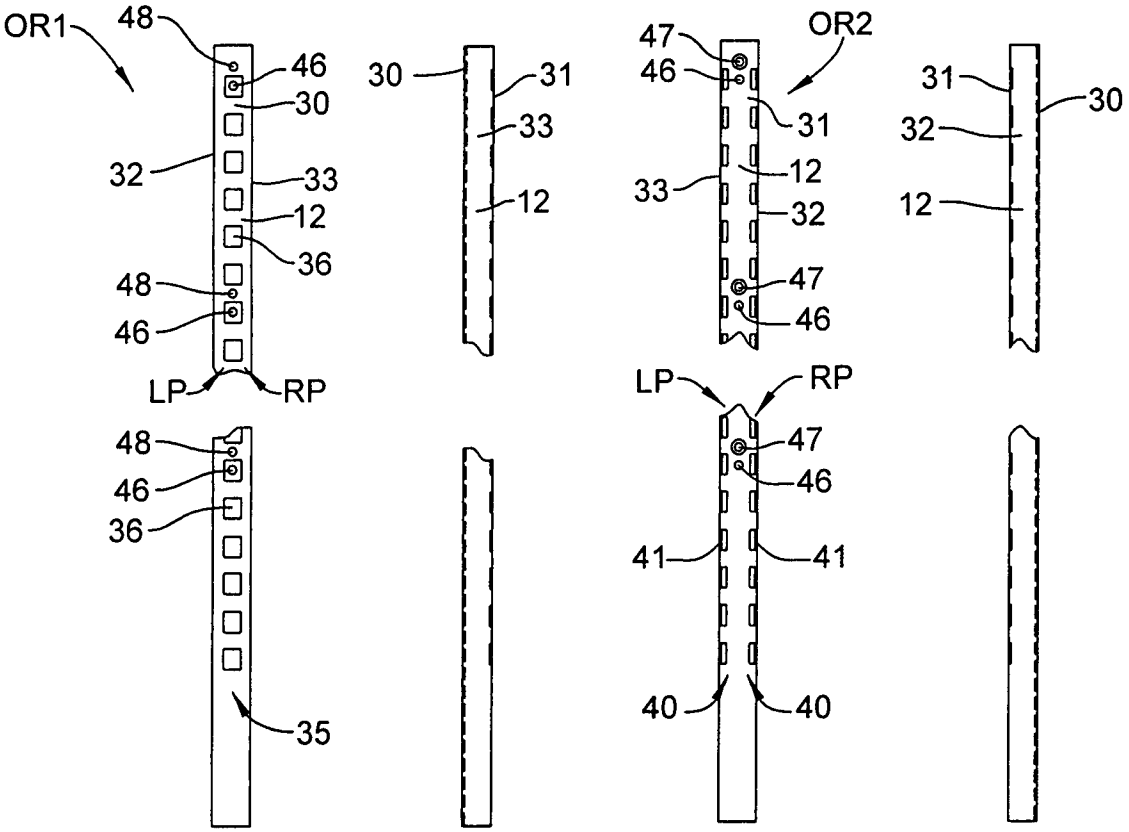
FIG. 2 is a first face side view of the wall track.
FIG. 3 is a right side view of the wall track.
FIG. 4 is a second face side view of the wall track.
FIG. 5 is a left side view of the wall track.
Figure 13:
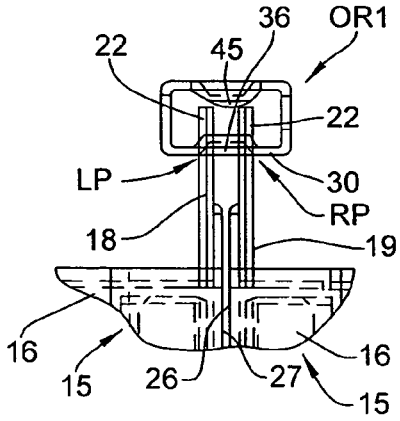
FIG. 13 is a partial top cross-sectional view showing two mounting brackets simultaneously engaged with the wall track of FIG. 1B.

Generally, the inventive wall track 12 is reversible so as to be usable with two adjacent cabinets 15 at the same time in orientation OR1 or else, in a reversed orientation OR2 usable with a single end of one cabinet. More particularly, the wall track 12 is usable in the second orientation designated by OR2 wherein in this second orientation, the wall track 12 is disposed in the endmost positions E1 and E2. At the intermediate locations IL1 as seen in FIGS. 1 and 1B, a wall track 12 is reversed to the first orientation OR1 for simultaneous joining to two serially adjacent furniture components 15. Referring to FIGS. 1A, 1B and 2-7, a wall track 12 has a tubular metal wall construction defined by four tube walls. These tube walls define opposite first and second mounting faces 30 and 31, as well as first and second side faces 32 and 33 of the first mounting face 30 (FIGS. 2, 6 and 8). A vertical row 35 of slots 36 is provided, which slots 36 are formed with a rectangular shape and extend vertically along the vertical centerline of the mounting face 30. The lateral width of these slots 36 is sufficiently wide so as to simultaneously accommodate two mounting brackets 18 and 19 in hooked engagement therewith as seen in FIG. 13. Essentially, the hooks 22 (FIG. 6) insert through the slot opening and then shift downwardly so as to hookingly engage the wall portion 38 which is disposed between each vertically adjacent pair of slots 36. The mounting face 30 has a slot pattern defined by a single row of double-width slots 36 that simultaneously accommodate two side-by-side rows of hooks 22 therein. The opposite side edges 39 in FIG. 6 of each slot 36 are provided so as to essentially sit close against the mounting brackets 18 and 19 and laterally locate the brackets 18 and 19 relative thereto.

Figure 7:
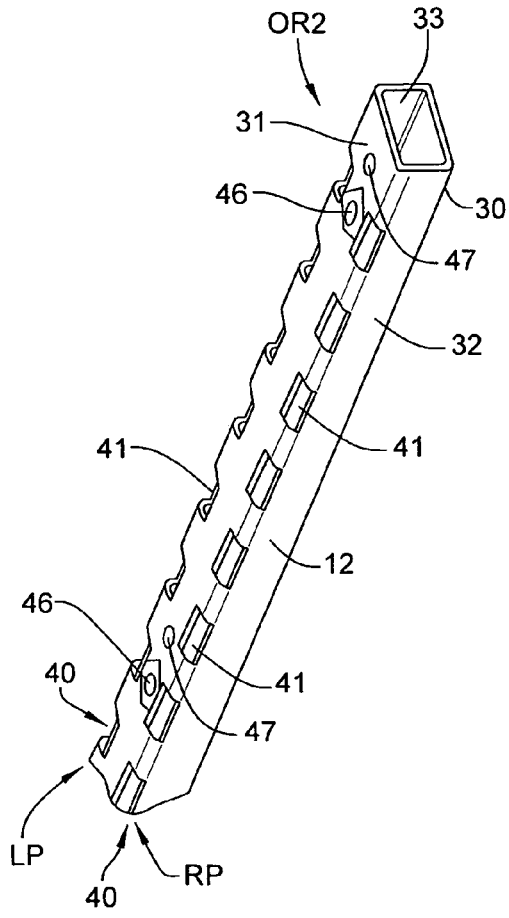
FIG. 7 is a perspective view showing a second mounting face.
Figure 8:
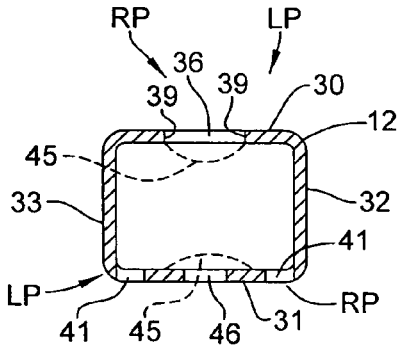
FIG. 8 is a top cross-sectional view of the wall track.
Figure 12:
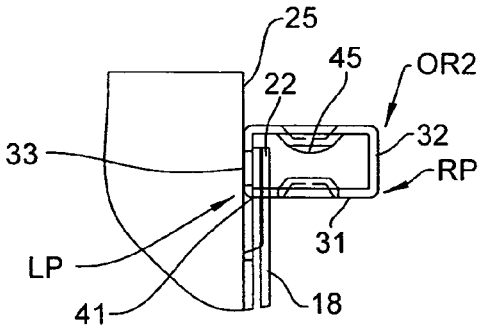
FIG. 12 is a partial top view showing engagement of a single bracket to the wall track of FIG. 1A.

Referring to FIGS. 4, 7 and 12, the opposite mounting face 31 is provided with two vertical rows 40 of slots 41 wherein each row 40 is located closely proximate to and preferably at the corner between the mounting face 31 and the respective one of the opposite side walls 32 and 33. These slots 41 have the same vertical spacing as the slots 36 and each row 40 is adapted to accommodate a single one of the brackets 18 or 19. Essentially, each row 40 defines one of a left mounting position LP and a right mounting position RP (FIGS. 4 and 12). The double-width slots 36 (FIG. 2) also define left and right mounting positions LP and RP, but these are disposed directly adjacent to each other in a single slot 36.

When the slots 36 are engaged with the brackets 18 and 19 as seen in FIG. 13, the bracket 18 at the right end of one storage unit 15 mounts in the left mounting position LP, while the bracket 19 of the rightwardly adjacent storage cabinet 15 mounts in the right mounting position RP. These brackets 18 and 19 are respectively mounted in the left and right mounting positions LP, RP when the wall track 12 is in the first orientation OR1 located at the intermediate locations IL1. However, at the end locations E2 where the wall track 12 is in the second orientation OR2, the leftmost bracket 18 (FIG. 12) mounts to the slots 41 in the left mounting position LP. This places the mounting bracket 18 closely adjacent to the bracket side face 32, substantially in alignment therewith, which allows the wall track 12 and mounting bracket 18, as well as its associated cabinet 15, to be mounted closely adjacent to the corner wall 25. At the least, the wall track 12 is substantially hidden and disposed behind the cabinets 15 so as to provide a more aesthetically pleasing appearance.

Figure 11:
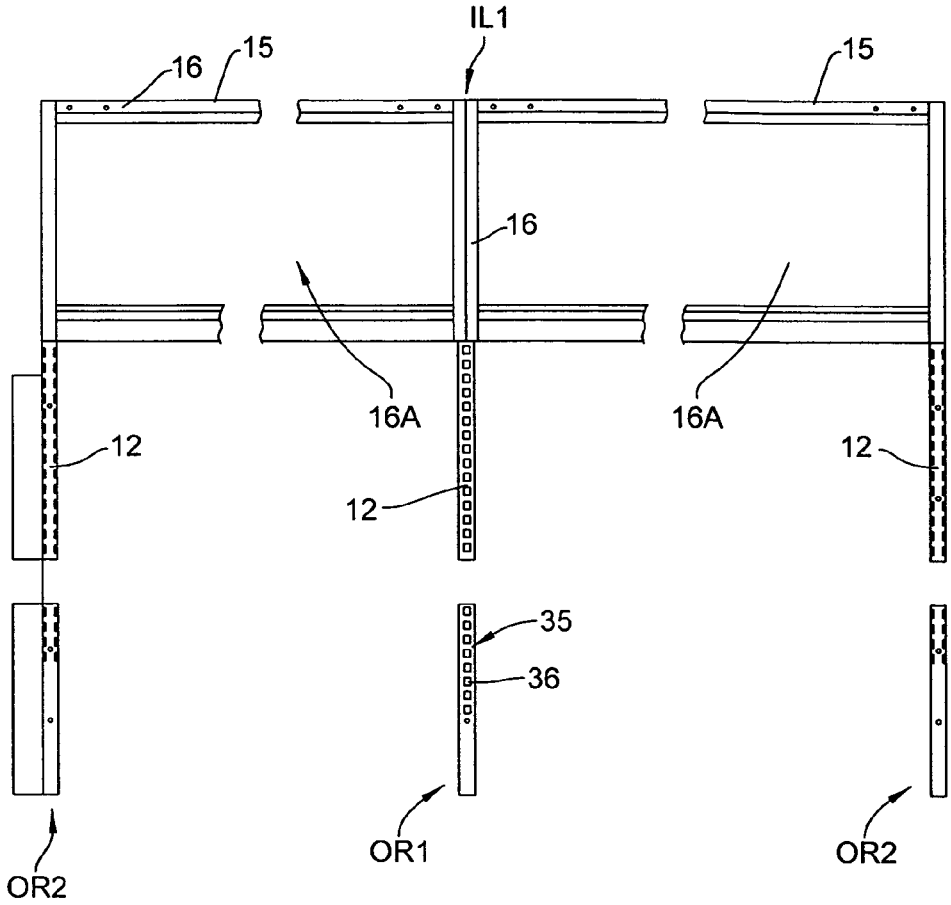
FIG. 11 is a front elevational view of the wall tracks and overhead storage units of FIG. 1.

With the bracket 12 reversed in the first orientation OR1 (FIG. 11), the same wall track 12 now can accommodate two overhead storage units simultaneously in engagement therewith wherein the opposed end faces 26 and 27 are disposed closely adjacent to each other as seen in FIGS. 11 and 13. If the wall track 12 was in the second orientation of FIG. 12, a substantially larger spacing would result between the cabinet end faces 26 and 27 which would be aesthetically undesirable.

In this manner, a single wall track 12 can be positionable in reversible first and second orientations OR1 and OR2 and readily provide for improved mounting of furniture components such as storage cabinets 15 thereon.

To mount wall track 12 to the wall by various fasteners 45 (FIGS. 12 and 13), fastener bores or fastener holes are provided at vertically spaced locations along each of the mounting faces 30 and 31. However, it is noted that the fasteners 45 are hidden within the interior of the wall track 12 due to an improved arrangement of fastener holes.

Figure 9:
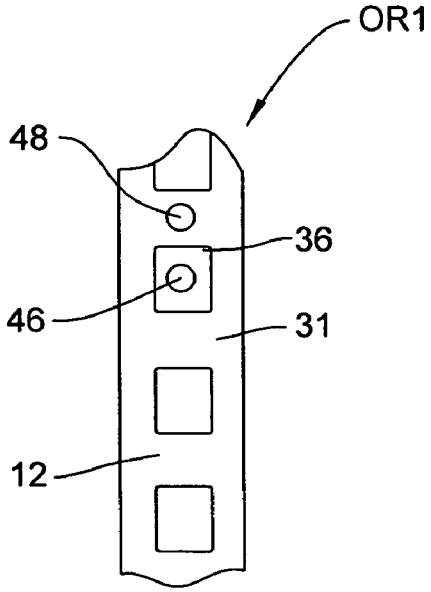
FIG. 9 is an enlarged partial view of the first face side showing the mounting hole pattern.
Figure 10:
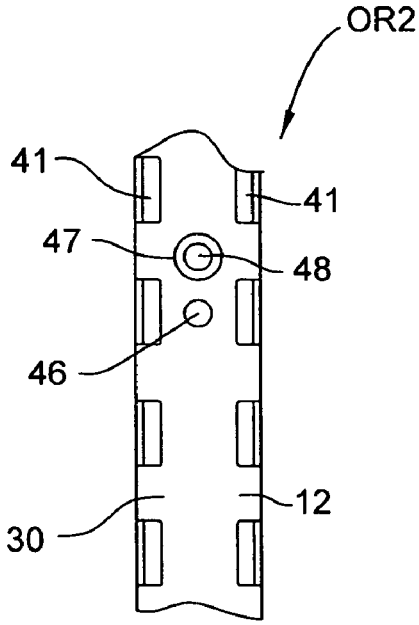
FIG. 10 is an enlarged partial view of the second face side showing the mounting hole pattern.

More particularly as to FIGS. 8-10, a first plurality of fastener bores 46 are provided in the mounting face 31 and extend through the mounting face 31 between slots 41 but in direct alignment with the wide slot 36 located on the opposite wall, namely mounting face 30. As seen in FIG. 9, the slot 36 is relatively oversized relative to the fastener bore 46, which permits the fastener 45 to be inserted into the bore 46 by passage through the forwardly disposed slot 36. As such, the fastener 45 is located within the interior of the hollow tube 12 as seen in FIG. 8 in diagrammatic phantom outline and is driven by a tool into threaded engagement with the wall 14.

Since the slots 31 and the opposite mounting face 30 are relatively narrow and located at the corners, it is not possible to pass a fastener through such narrow slots 41. Hence, mounting face 30 is provided with an enlarged through hole 47 that passes through the mounting face 30 and aligns with a fastener bore 48 that is formed in the opposite wall, namely mounting face 31 as seen in FIGS. 9 and 10. Fastener bore 48 and through hole 47 are aligned with each other but offset vertically from the slots 36 and fastener bores 46 described above. The size of through hole 47 is sufficiently large so as to allow for the passage of the fastener 45 entirely therethrough so that the fastener head is again located within the interior of the tube 12 as also seen at the top of FIG. 8. Hence, track 12 is mountable in either of the orientations OR1 and OR2, with the fasteners 45 in either orientation being hidden within the interior of the tube 12. This is further illustrated in FIGS. 12 and 13.

During assembly, the wall tracks 12 are positioned with the wall tracks 12 in the second orientation OR2 at the endmost positions of the furniture system. The wall track 12 is mounted in the first orientation OR1 at those intermediate locations aisle 1 illustrated in FIG. 1. Thereafter, the various furniture components 15 are then suspended or hung onto the respective slot patterns. The slots 36 simultaneously mount brackets 18 and 19 thereto, or slots 41 either mount thereto the bracket 18 at the left end E1 or the bracket 19 at the right end E2. At the right end E2, the bracket 19 would engage the slots 41 in the right mounting position RP as defined by the row 40 of slots 41 shown in FIG. 7.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. A wall track system for mounting on a wall, comprising:

a plurality of suspended storage components each having laterally spaced apart left and right ends and having first and second support brackets at said left and right ends, which are laterally spaced apart, each said support bracket having slot-engaging hooks projecting therefrom for supporting said storage component on the wall; and a plurality of vertically elongate wall tracks mountable to the wall in laterally spaced relation and engagable with said storage components which are suspendable therefrom, each of said wall tracks having a tubular wall defining a hollow interior and first and second mounting faces which are disposed on respective sides of said hollow interior and face in first and second directions, each of said first and second mounting faces having a lateral width defined between respective vertically-extending side edges, said wall track being selectively mountable to the wall in first and second orientations wherein said first orientation has said first mounting face facing outwardly from a wall surface for engagement with said support brackets and said second orientation has said second mounting face facing outwardly from the wall surface for engagement with said support brackets, said first and second mounting faces respectively having first and second patterns of respective first and second slots each arranged in a longitudinal row in vertically spaced relation for engagement with said hooks of said first and second support brackets, said first pattern of said first slots defining laterally-adjacent left and right mounting locations for engagement with said second and first support brackets wherein said second support bracket of a first said storage component is mountable in said left mounting location of said first pattern, and said first support bracket of a second said storage component is mountable in said right mounting location of said first pattern so that adjacent said ends of said first and second storage components are positioned closely adjacent to each other and supportable simultaneously on a common said wall track, said second pattern of said second slots defining laterally-spaced left and right mounting locations for said first and second support brackets proximate said respective side edges wherein said left mounting location of said second pattern is engagable with said first support bracket at said left end of a said storage component, such that said wall track and said right mounting location of said second pattern are disposed behind said storage component and wherein said right mounting location of said second pattern is engagable with said second support bracket at said right end of a said storage component such that said wall track and said left mounting location of said second pattern are disposed behind said storage component.

2. The wall track system according to claim 1, wherein said plurality of said storage cabinets are mountable to the wall in side-by-side relation in a lateral row wherein said wall tracks are provided at end locations at opposite ends of said lateral row and said wall tracks are provided at one or more intermediate locations between said opposite ends at each junction between two adjacent said storage components.

3. The wall track system according to claim 2, wherein said wall tracks at said opposite ends are mounted to the wall in said second orientation and support a respective end one of said storage components and said wall tracks at said intermediate locations are mounted to the wall in said first orientation and support an adjacent pair of said storage components.

4. The wall track system according to claim 3, wherein each said wall track at said opposite ends of said lateral row is laterally aligned with a respective said end of said storage components supported thereby.

5. The wall track system according to claim 1, wherein said wall track in said second orientation has said side edge adjacent the support bracket engaged therewith aligned with a terminal edge of said storage component with the opposite said side edge spaced laterally behind said storage component.

6. The wall track system according to claim 1, wherein said first slots each have a double-width able to simultaneously receive said hooks of two of said support brackets in a single said first slot, said second slots having a single width able to receive only a single said hook of said support bracket therein.

7. The wall track system according to claim 6, wherein said first slots of said first pattern have said left and right mounting locations being centrally located side by side with each other along a vertical center axis of said wall track.

8. The wall track system according to claim 6, wherein said second slots of said second pattern have said left and right mounting locations laterally spaced apart near wall track corners extending along said side edges.

9. The wall track system according to claim 8, wherein said first slots of said first pattern have said left and right mounting locations being centrally located side by side with each other along a vertical center axis of said wall track.

10. The wall track system according to claim 1, wherein said first mounting face abuts against the wall surface when in said second orientation and said second mounting face abuts against the wall surface when in said first orientation.

11. The wall track system according to claim 1, wherein said second orientation is reversed relative to said first orientation with said first and second mounting faces disposed on opposite sides of said wall track.

12. The wall track system according to claim 11, which includes fasteners securing said wall track to the wall wherein each said wall track includes first and second fastener bores extending through said first and second mounting faces respectively for mounting said wall tracks to the wall, each of said second fastener bores being aligned with a said first slot which permits the fastener to be inserted through said first slot with said fastener extending through said second fastener bore but hidden within said hollow interior, said second mounting face further including through holes aligned with said first fastener bores and larger than said fasteners to permit the fastener to be inserted through said through hole with said fastener extending through said first fastener bore but hidden within said hollow interior.

13. The wall track system according to claim 12, wherein said first slots and said through holes are sized to permit tool-driven engagement of the fasteners with the wall.

14. The wall track according to claim 11, wherein said first mounting face abuts against the wall surface when in said second orientation and said second mounting face abuts against the wall surface when in said first orientation.

15. A wall track which is mountable on a wall and which is configured to support a plurality of suspended storage components each having laterally spaced apart left and right ends and first and second support brackets at said left and right ends, which said support brackets are laterally spaced apart and each have slot-engaging hooks projecting therefrom for supporting said storage component on the wall, comprising the improvement wherein:

said wall track is vertically elongate and mountable to the wall in laterally spaced relation with other said wall tracks, said wall track being vertically elongate and having a tubular wall defining a hollow interior and first and second mounting faces which are disposed on opposite sides of said hollow interior and face in opposite first and second directions, each of said first and second mounting faces having a lateral width defined between respective vertically-extending side edges which extend along corners of said tubular wall, said wall track being selectively mountable to the wall in first and second orientations wherein said first orientation has said first mounting face facing outwardly from a wall surface for engagement with the support brackets and said second orientation has said second mounting face facing outwardly from the wall surface for engagement with the support brackets, said second orientation being reversed relative to said first orientation;

said first and second mounting faces respectively having first and second patterns of first and second slots each arranged in a longitudinal row in vertically spaced relation for engagement with the hooks, said first pattern of said first slots defining laterally-adjacent left and right mounting locations for engagement with first and second support brackets wherein the second support bracket of a first storage component is mountable in said left mounting location of said first pattern, and the first support bracket of a second storage component is mountable in said right mounting location of said first pattern so that adjacent ends of first and second storage components are positioned closely adjacent to each other and supportable simultaneously on a common said wall bracket, said second pattern of said second slots defining laterally-spaced left and right mounting locations for first and second support brackets proximate said respective side edges wherein said left mounting location of said second pattern is engagable with the first support bracket at a left end of a storage component with said wall track and said right mounting location of said second pattern disposed behind a storage component and wherein said right mounting location of said second pattern is engagable with a second support bracket at said right end of a said storage component with said wall bracket and said left mounting location of said second pattern disposed behind a storage component; and said wall track being engagable with fasteners securing said wall track to the wall wherein said wall track includes first and second fastener bores extending through said first and second mounting faces respectively for mounting said wall track to the wall, each of said second fastener bores being aligned with a said first slot which permits the fastener to be inserted through said first slot with said fastener extending through said second fastener bore but hidden within said hollow interior, said second mounting face further including through holes aligned with said first fastener bores and larger than said fasteners to permit the fastener to be inserted through said through hole with said fastener extending through said first fastener bore but hidden within said hollow interior.

16. The wall track according to claim 15, wherein said first slots and said through holes are sized to permit tool-driven engagement of the fasteners with the wall.

17. The wall track according to claim 15, wherein said first slots each have a double-width able to simultaneously receive hooks of two support brackets in a single said first slot, said second slots having a single width able to receive only a single hook of the support bracket therein.

18. The wall track according to claim 17, wherein said first slots of said first pattern have said left and right mounting locations being centrally located side by side with each other along a vertical center axis of said wall track.

19. The wall track according to claim 17, wherein said second slots of said second pattern have said left and right mounting locations laterally spaced apart near said corners extending along said side edges.

20. The wall track according to claim 19, wherein said first slots of said first pattern have said left and right mounting locations being centrally located side by side with each other along a vertical center axis of said wall track.

* * * * *